United States Patent [19]

Bolton et al.

[11] Patent Number: 4,643,145

[45] Date of Patent: Feb. 17, 1987

[54] REINFORCEMENT OF ENGINE BLOCKS

[75] Inventors: Albert E. Bolton, Sutton Coldfield; William J. Hepworth, Hampton-in-Arden, both of England

[73] Assignee: AE PLC, Warwickshire, England

[21] Appl. No.: 679,308

[22] Filed: Dec. 7, 1984

[30] Foreign Application Priority Data

Dec. 10, 1983 [GB] United Kingdom ..... 8333036

[51] Int. Cl.[4] ..... F02F 7/00

[52] U.S. Cl. ..... 123/195 R; 164/111

[58] Field of Search ..... 123/195 R, 195 C, 195 H; 164/111

[56] References Cited

U.S. PATENT DOCUMENTS

| | | | |
|---|---|---|---|
| 1,865,299 | 6/1932 | Berry | 92/230 |
| 2,098,451 | 11/1937 | Gilmore | 123/195 R |
| 2,729,523 | 1/1956 | Dietrich et al. | 92/220 |
| 3,304,134 | 2/1967 | Allen | 123/195 R |
| 4,023,613 | 5/1977 | Vebayasi et al. | 164/111 |
| 4,106,745 | 8/1978 | Carrow | 264/278 |
| 4,445,472 | 5/1984 | Ogawa et al. | 123/195 R |
| 4,465,041 | 8/1984 | Hayashi | 123/195 R |

FOREIGN PATENT DOCUMENTS

| | | |
|---|---|---|
| 3135683 | 3/1983 | Fed. Rep. of Germany . |
| 735087 | 8/1955 | United Kingdom . |
| 2104622 | 3/1983 | United Kingdom . |

*Primary Examiner*—Craig R. Feinberg

*Attorney, Agent, or Firm*—Leydig, Voit & Mayer

[57] ABSTRACT

The problem of cracking in scantlings of aluminium or aluminium alloy engine blocks by direct and torsional forces applied thereto by a crankshaft is mitigated by casting, into the scantlings, reinforcements of a ferrous material. Each reinforcement includes threaded bosses for receiving the bolts which hold an associated cap onto the scantling and also flat elongate members which extend into the scantling. Since the threads are of a ferrous material, they are more resistant to damage than similar threads of aluminium or aluminium alloy and the elongate members spread the loading throughout the scantling, so reducing the tendency of these loads to crack the scantling. This technique can be of particular benefit where an engine is being modified in a way which produces increased stresses; for example where a petrol engine is being converted for use as a diesel engine.

13 Claims, 3 Drawing Figures

REINFORCEMENT OF ENGINE BLOCKS

BACKGROUND TO THE INVENTION

1. Field of the Invention

The invention relates to the reinforcement of engine blocks of aluminium or aluminium alloy.

Engine blocks cast of aluminium or aluminium alloy have the primary advantage that they are light in weight in comparison with ferrous materials, so offering the opportunity of achieving high power/weight ratios in the engine. Aluminium or aluminium alloys, while having the advantage of lightness of weight have the disadvantage that they are not as strong as ferrous materials and are not as well able to withstand the stresses encountered in engine operation. One part of an engine block which is subject to particularly high stresses is the scantlings, which provide supports for the bearings of a crankshaft. These crankshaft bearings are secured in position on the scantling supports by associated caps which are bolted onto the block at the associated scantlings.

The crankshaft is loaded on either side of each scantling by the forces generated in associated connecting rods during operation of the engine. The direction and value of these forces are not the same on each side of each scantling at any one point in the engine cycle and so there is a resultant twisting force applied by the crankshaft to each scantling and its associated cap. This problem can be particularly acute where the engine is a V-configured engine, because adjacent connecting rods can generate oppositely directed forces and/or where the engine is a diesel engine, because combustion chamber pressures are higher in diesel engines than in petrol engines and thus the twisting forces are greater. The effect of these forces in combination with the direct forces is to tend to crack the aluminium or aluminium alloy of the engine block.

2. Review of the Prior Art

It has been proposed previously to form the threads for receiving the bolts holding down the caps, in reinforcements introduced into the block during casting. It has been found, however, that, although such reinforcements prevent the bolts being pulled out of their threads, they do not affect the resistance of the scantlings to the twisting forces. It has also been proposed to use two side-by-side bolts on each side of each cap or two bolts set at right angles at each side of each cap but neither of these have proved entirely satisfactory in resisting the effects of the twisting forces.

An alternative proposal has been to increase the thickness of each scantling to allow them better to resist the twisting loads. Although this offers a possibility of success, it has the disadvantages of increasing the weight, complexity and volume of the block. It is also a solution which is difficult to use where an engine block is to be uprated to take increased loads; for example, where a petrol engine block is to be converted to a diesel engine block, because, in this case, the mould or die used for producing the block will require alteration, and this can be difficult and expensive, particularly where the block is gravity die cast because redesigning such dies can be very expensive.

SUMMARY OF THE INVENTION

According to a first aspect of the invention, there is provided a scantling reinforcement for incorporation in an aluminium or aluminium alloy engine block, the scantling reinforcement being of ferrous material and including at least one threaded hole for receiving a bolt for securing a cap onto the associated scantling, and at least one elongate portion which extends away from the screw thread and lies generally in a plane including the axis of said threaded hole for reducing the tendency of a scantling to crack under the twisting loads encountered in operation.

According to a second aspect of the invention, there is provided a method of manufacturing a block for an internal combustion engine formed with a plurality of scantlings each providing a bearing support for receiving a respective bearing of a crankshaft, each bearing being secured by an associated cap which is bolted onto the block at the associated scantling, the method comprising casting the block from aluminium or an aluminium alloy and, during casting, incorporating into at least one scantling a reinforcement according to the first aspect of the invention.

According to a third aspect of the invention, there is provided an aluminium or aluminium alloy block for an internal combustion engine and formed with a plurality of scantlings, each providing a bearing support for receiving a respective bearing of a crankshaft, each bearing being secured by an associated cap which is bolted onto the block at the associated scantling, at least one scantling having incorporated therein a reinforcement according to the first aspect of the invention and for receiving at least an associated one of said bolts to reduce the tendency of the scantling to crack under twisting loads encountered in operation.

BRIEF DESCRIPTION OF THE DRAWINGS

The following is a more detailed description of an embodiment of the invention, by way of example, reference being made to the accompanying drawings in which.

DESCRIPTION OF THE PREFERRED EMBODIMENTS

Figure 1:
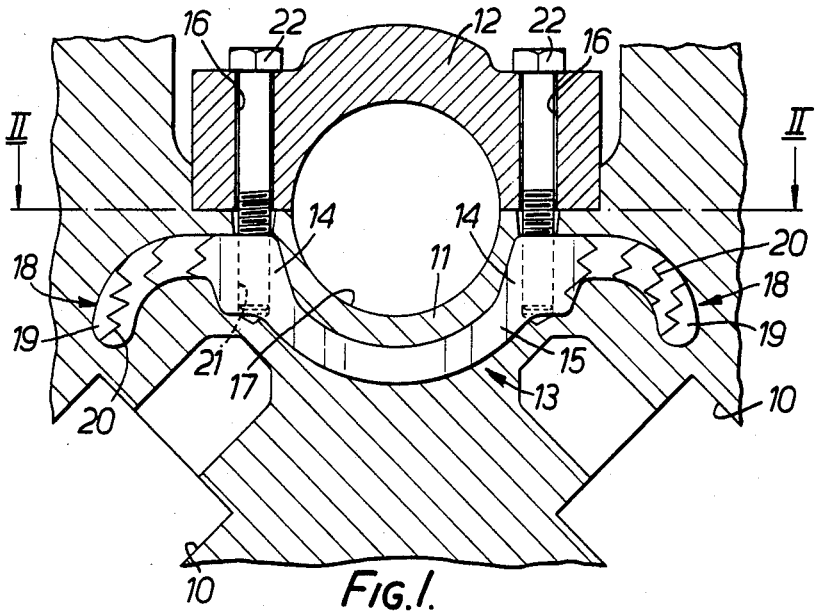
FIG. 1 is a schematic cross-section through a scantling of an aluminium or an aluminium alloy engine block showing a cap bolted onto a reinforcement incorporated in the scantling.

Referring to FIG. 1, the engine block is gravity die cast from aluminium or aluminium alloy. The block is of V-configuration with the cylinders, parts of two of which are shown at 10, arranged in two inclined banks. The crankshaft (not shown) is provided with a plurality of axially spaced bearings, each of which is held in the cylinder block between a scantling 11 formed in the block and a cap 12 bolted onto the scantling. The caps 12 are cast from a ferrous material.

Each scantling incorporates a reinforcement 13 of a ferrous material which has a coefficient of thermal expansion substantially equal to the coefficient of thermal expansion of the aluminium or aluminium alloy, to overcome problems caused by differential expansion. The reinforcement may be made by casting and may be of an austentic iron containing up to 20% nickel.

Figure 2:
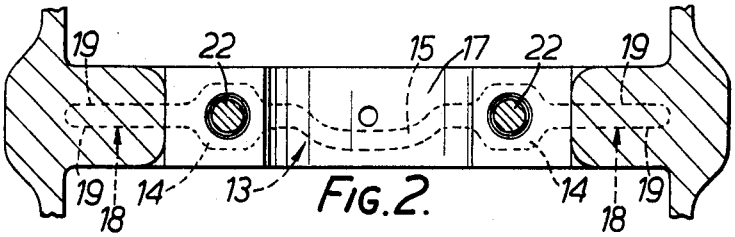
FIG. 2 is a section on the line II—II of FIG. 1.

The reinforcement 13 comprises two screw threaded bosses 14 with a connecting piece 15 between them, which holds them at a spacing equal to the spacing between the bolt holes 16 in the associated cap 12. The curvature of the connecting piece is to allow it to pass beneath the curved bearing support 17 of the associated scantling 11. As seen in FIG. 2, the connecting piece 15 has a cranked portion lying to one side of its own plane to avoid obstructing an oil drainage hole formed in the block.

An elongate torsion resisting member 18 extends outwardly from each threaded boss 14 and lies generally in a plane parallel to the plane of axes of the threaded bosses 14. Each member 18 is curved in its plane and is formed with two parallel surfaces 19 which also lie in planes parallel to the plane of the axes of the threaded portions. Each surface 19 is formed with a plurality of grooves 20, with each groove having a zig-zag configuration and extending in a direction generally parallel to the axis of the threads. The grooves 20 on one surface 19 are offset relatively to the grooves 20 on the other surface 19 to reduce the weakening effect of the grooves 20 on the reinforcement 13.

The reinforcements 13 for the scantlings 11 are positioned in the engine block die with rods (not shown) screwed into the threaded bosses 14. The die is then gravity filled with molten aluminium or aluminium alloy to cast the block around the reinforcements 13. After solidification, the casting is removed from the die and the rods removed from the reinforcements 13 to form bolt holes 21 leading to the threaded bosses 14 of the reinforcements 13.

Figure 3:
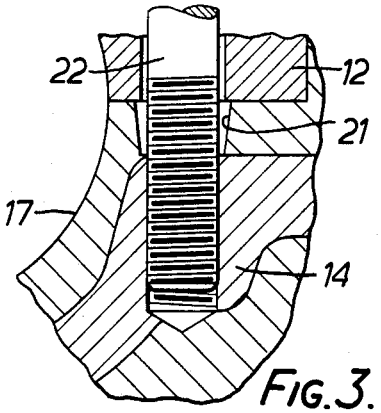
FIG. 3 is an enlarged view of a part of FIG. 1 showing a bolt passing through a cap and the block and engaging in a scantling.

After machining, the engine is assembled, and this includes placing the bearings on the crankshaft on the scantling bearing supports 17 then securing the caps 12 over the bearings by the insertion of bolts 22 into the threaded bosses 14 and their subsequent tightening. As seen in FIG. 3, the bolt holes 21 are of greater diameter than the bolts 22 so that there is a clearance between them. This ensures that only a minimum, largely compressive, load is applied to the scantling in this area. The remainder of the engine is then assembled.

In operation, pistons reciprocate in the cylinders and their motion is translated via connecting rods (not shown) to the crankshaft, which converts this motion into a rotational movement which drives the vehicle. Because the cylinders fire in succession and, in the present case where the engine is of V-configuration, because the line of action adjacent connecting rods on either side of the scantling is angularly displaced, the crankshaft imposes loads both in directions lying in the plane of the scantling and twisting loads about axes lying in the plane of the scantling and twisting loads about axes lying in the plane of the scantling 11. The effect of these loads is to try and tear the bolts 22 from their mountings and to twist and crack the scantling 11.

The reinforcements 13 resist these forces by providing threads for the bolts 22 which are of a ferrous material that is much stronger than the aluminium or aluminium alloy of the casting, so resisting damage to the threads by the crankshaft forces. In addition, the elongate members 18, since they lie in a plane generally parallel to the plane of the scantling 11, resist twisting forces about axes lying in said plane. The flat surfaces 19 of these members 18 spread the twisting loads over the scantling 11 and so reduce their intensity and damaging effect. The grooves 20 ensure that the reinforcements 13 are firmly bonded in the casting, so that there is no possibility of relative movement between these parts, and so that the forces are reliably transmitted from the reinforcement 13 to the scantling 11. Any defect in the mechanical bonding between the aluminium casting and the iron reinforcement is prevented from spreading by the grooves 20.

Thus, the use of this reinforcement 13 improves substantially the ability of the scantling 11 to withstand operational stresses. This can be of particular benefit where it is desired to increase the stresses on an existing block, which may occur, for example, when a block for a petrol engine is being converted for use in a diesel engine, where the stresses are higher by virtue of the increased compression ratios.

It will be appreciated that the reinforcement 13 can be varied in a number of ways. The members 18 need not be curved, they could be of any convenient shape, to avoid other cylinder block features. In addition, the grooves 20 need not be of zig-zag configuration they may be formed as a grid or in any other way. The reinforcement 13 may be provided with recesses in which the aluminium or aluminium alloy forms a key, so connecting the two parts together. More than one screw thread may be provided in each boss 14; two screw threads may, for example, be provided and these can be parallel or inclined to one another. All scantlings may be provided with reinforcements 13, as described above, or only selected scantlings may be so reinforced.

The connecting piece 15 may be omitted, so that each reinforcement comprises simply a threaded boss 14 and an elongate torsion-resisting member 18 extending therefrom.

Although the engine has been shown of V-configuration, there may be benefits in using reinforcements in in-line configurations.

We claim:

1. An aluminium alloy block for an internal combustion engine comprising:

a plurality of scantlings, means defining a bearing support formed on each scantling for providing a bearing support for a respective bearing of a crankshaft, two surfaces on each scantling on opposite sides of said means defining a bearing support for engagement with co-operating surfaces of an associated cap, means defining a bolt hole leading from each said surface into said scantling for receiving a bolt securing said associated cap on said scantling, a scantling reinforcement of a ferrous material incorporated in at leat one scantling, means defining a threaded hole formed in said scantling reinforcement, said threaded hole means forming a continuation of said bolt hole means in the scantling and threadably receiving a substantial threaded portion of said bolt, an elongate torsion resisting member formed on the scantling reinforcement, extending away from the associated threaded hole means and lying generally in a plane including the axis of said threaded hole means to reduce tendency of the associated scantling to crack under twisting loads.

2. An engine block according to claim 1, wherein all the scantlings are provided with reinforcements.

3. An engine block according to claim 1, wherein only selected scantlings are provided with reinforcements.

4. An engine block according to claim 3, wherein the engine block is for a V-configuration engine.

5. A scantling reinforcement of ferrous material for incorporation in an aluminium alloy engine block comprising:

means defining an elongate threaded hole for forming a continuation of a bolt hole in the associated scantling and for threadably receiving a substantial threaded portion of a bolt to secure a cap onto the associated scantling, and an elongate torsion resisting member extending away from the associated threaded hole means and lying generally in a plane including the axis of said threaded hole means to reduce tendency of the associated scantling to crack under twisting loads, when incorporated therewithin.

6. A scantling reinforcement according to claim 5, wherein the at least one elongate member is curved in the plane thereof, the curvature being downwardly relative to a leading end of the threaded hole means.

7. A scantling reinforcement according to claim 5, wherein the reinforcement is made of an austenitic iron including up to 20% of nickel.

8. A scantling reinforcement according to claim 5, wherein the at least one elongate member has two parallel but spaced surfaces lying in planes generally parallel to the plane of the member, each surface being provided with at least one groove for forming an interlock between the reinforcement and the engine block.

9. A scantling reinforcement according to claim 8, wherein the at least one groove on one surface of the elongate member is staggered relatively to the at least one groove on another surface of said elongate member, to prevent weakening of the reinforcement.

10. A scantling reinforcement according to claim 8, wherein the at least one groove is of zig-zag configuration extending generally along a line parallel to the axis of the at least one threaded hole.

11. A scantling reinforcement according to claim 5, wherein the reinforcement provides two threaded holes for receiving respective bolts on oppostie sides of the associated cap and also includes two elongate members, each one extending away from each screw thread.

12. A scantling reinforcement according to claim 11 wherein each threaded hole is formed in an associated boss from which the associated elongate member extends, the bosses being interconnected by a connecting piece.

13. A scantling reinforcement according to claim 12, wherein the connecting piece includes a central cranked portion lying to one side of the plane of the remainder of the connecting piece.

* * * * *